US008066391B2

(12) United States Patent
Zhong

(10) Patent No.: US 8,066,391 B2
(45) Date of Patent: Nov. 29, 2011

(54) LUMINARY

(75) Inventor: Guisheng Zhong, Taipei Hsien (CN)

(73) Assignee: Jiangmen Minhua Electric Co., Ltd., Jiangmen (CN)

( * ) Notice: Subject to any disclaimer, the term of this patent is extended or adjusted under 35 U.S.C. 154(b) by 341 days.

(21) Appl. No.: 12/413,984

(22) Filed: Mar. 30, 2009

(65) Prior Publication Data

US 2010/0002411 A1 Jan. 7, 2010

(30) Foreign Application Priority Data

Jul. 2, 2008 (CN) ..... 2008 1 0130419

(51) Int. Cl.
*F21V 19/04* (2006.01)

(52) U.S. Cl. ..... 362/20; 362/276; 362/228

(58) Field of Classification Search ..... 362/20, 362/276, 802, 295, 394, 411, 227, 228, 230, 362/231

See application file for complete search history.

(56) References Cited

U.S. PATENT DOCUMENTS

| | | | | |
|---|---|---|---|---|
| 5,400,228 | A * | 3/1995 | Kao | 362/231 |
| 5,685,637 | A * | 11/1997 | Chapman et al. | 362/263 |
| 6,033,087 | A * | 3/2000 | Shozo et al. | 362/244 |
| 6,045,232 | A * | 4/2000 | Buckmaster | 362/20 |
| 6,491,417 | B1 * | 12/2002 | Haen et al. | 362/485 |
| 6,756,893 | B1 * | 6/2004 | Fernandez | 340/458 |
| 7,374,310 | B2 * | 5/2008 | Barozzini et al. | 362/228 |
| 7,476,002 | B2 * | 1/2009 | Wolf et al. | 362/231 |

* cited by examiner

*Primary Examiner* — Bao Q Truong

(74) *Attorney, Agent, or Firm* — C. G. Mersereau; Nikolai & Mersereau, P.A.

(57) ABSTRACT

A luminary has a central lamp, an emergency lamp and a control box. The emergency lamp is ring-shaped and mounted around a light-emitting end of the central lamp and has a base and a circuit board. The circuit board has an LED set and a cable set connected to the LED set. The control box is electrically connected to cable set of the circuit board, adapted to connect to an AC power and has a battery. The control box drives the LED set when an outage of the AC power occurs. Since emergency illumination is provided by the emergency lamp and is independent of normal illumination provided by the central lamp, battery power for emergency illumination can be kept from being quickly consumed by the central lamp that is usually power-consuming.

8 Claims, 6 Drawing Sheets

LUMINARY

BACKGROUND OF THE INVENTION

1. Field of the Invention

The present invention relates to a luminary, especially to a luminary providing two light sources with the same emission direction for normal illumination and emergency illumination.

2. Description of the Related Art

An emergency light lights up automatically during a blackout using a battery back-up for power and is installed in buildings or public places.

A conventional luminary may combine normal and emergency illuminations through the same light source. When utility power is normally supplied, the light source emits light by using the utility power; when circuits of the luminary senses an outage of the utility power, the light source uses battery power to emit light for emergency illumination. Therefore, the luminary uses the same light source to perform both normal and emergency illumination and is simple.

However, normal illumination usually requires higher power consumption as compared with emergency illumination. Since the conventional luminary uses the same light source for both normal and emergency illumination, the light source is designed with large power requirements. Therefore the battery of the luminary needs larger capacity to provide electricity to the light source to keep a sufficient time for emergency illumination and increases cost of the luminary.

To overcome the shortcomings, the present invention provides a luminary to mitigate or obviate the aforementioned problems.

SUMMARY OF THE INVENTION

The main objective of the invention is to provide a luminary that provides two light sources with the same emission direction for normal illumination and emergency illumination.

The luminary in accordance with the present invention comprises a central lamp, an emergency lamp and a control box.

The central lamp has a light-emitting end.

The emergency lamp is ring-shaped and mounted around the light-emitting end of the central lamp and has a base and a circuit board.

The base is ring-shaped, is attached to and surrounds the light-emitting end of the central lamp.

The circuit board is ring-shaped, mounted on the base and has a surface, an LED set and a cable set. The LED set is mounted on the surface and faces an identical direction with the light-emitting end of the central lamp. The cable set is connected to the LED set.

The control box is electrically connected to the cable set of the circuit board, adapted to connect to an AC power and has a battery. The control box drives the LED set when an outage of the AC power occurs by using power of the battery.

The emergency lamp emits light in a direction the same with the central lamp, therefore the luminary maintains the same lighting arrangement during a blackout. Furthermore, emergency illumination is provided by the emergency lamp and is independent of normal illumination provided by the central lamp, so as to prevent battery power for emergency illumination from being quickly consumed by the central lamp that is usually power-consuming.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
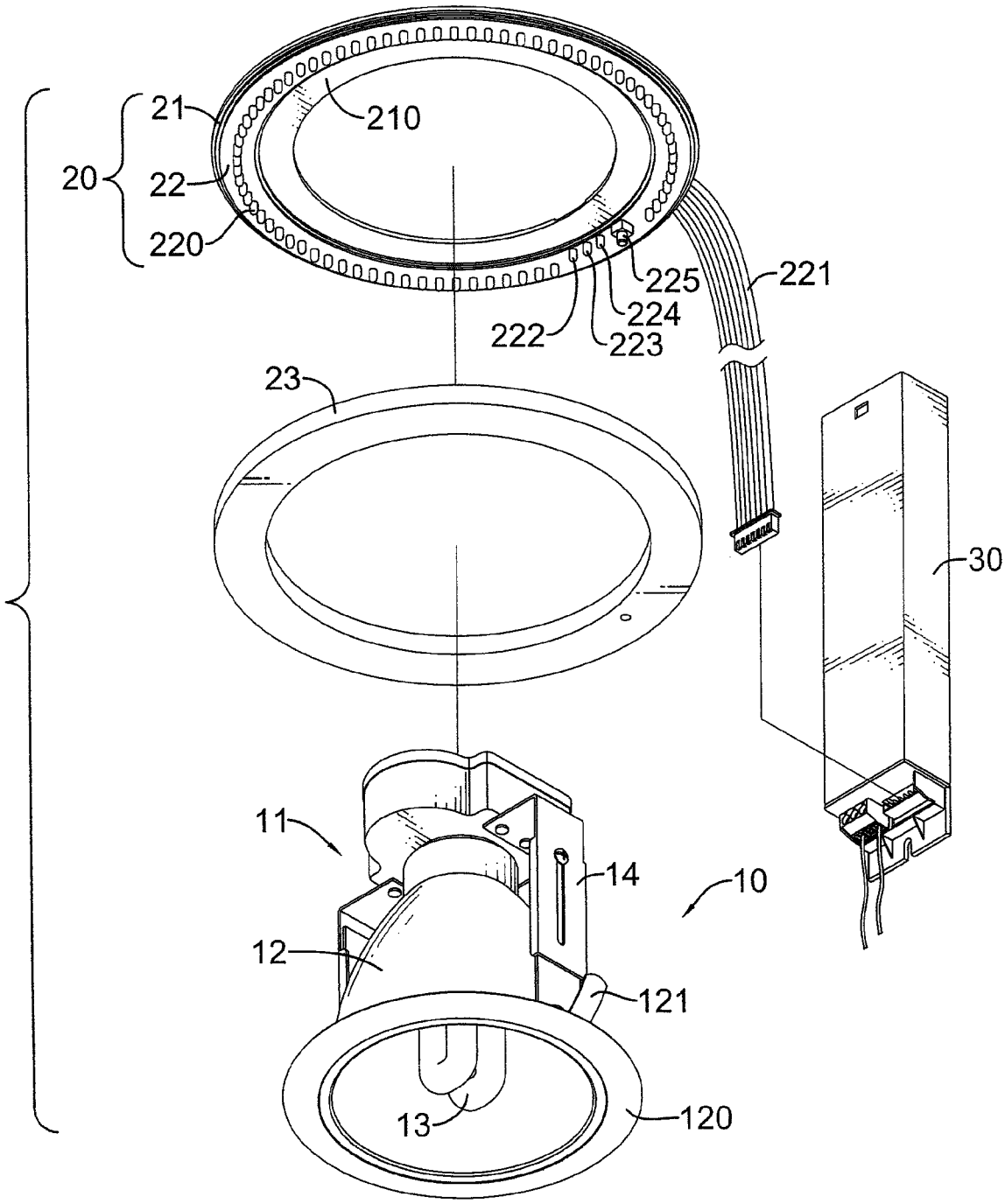
FIG. 1 is a partially exploded perspective view of a luminary in accordance with the present invention.

With reference to FIG. 1, a luminary in accordance with the present invention comprises a central lamp (10), an emergency lamp (20) and a control box (30).

The central lamp (10) has a light-emitting end and may have a socket (11), a shade (12), a light emitting element (13) and a frame (14). The shade (12) is attached to the socket (11) and has a front open end and may have a circular flange (120) and multiple reeds (121). The circular flange (120) is formed on and protrudes from the front open end. The reeds (121) are mounted on the front open end, adjacent to the circular flange (120) and are elastic. The light emitting element (13) is mounted on the socket (11) in the shade (12). The frame (14) is fixed to the socket (11) and the shade (12).

The emergency lamp (20) is ring-shaped, mounted around the light-emitting end of the central lamp (10) and has a base (21), a circuit board (22) and may have a cover (23).

Figure 2:
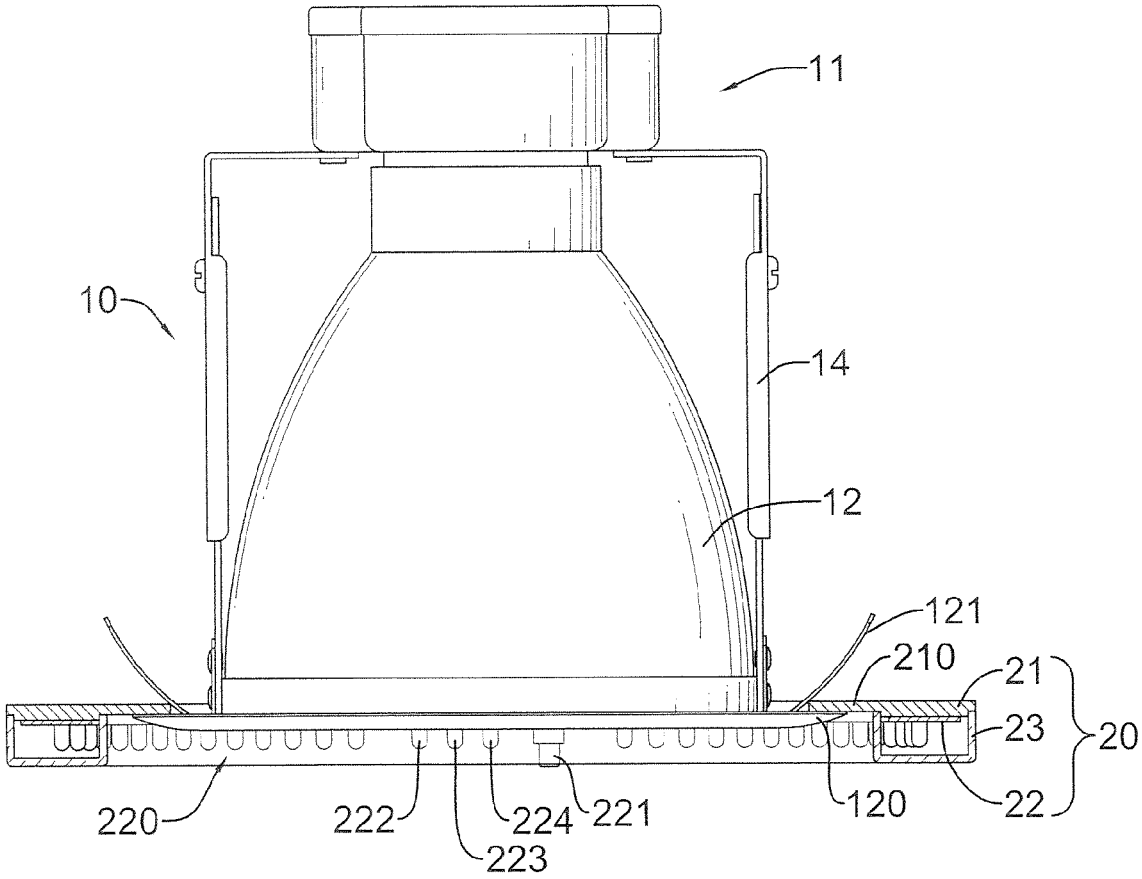
FIG. 2 is a partial, cross sectional side view of an emergency lamp attached to a central lamp of the luminary in FIG. 1.
Figure 3:
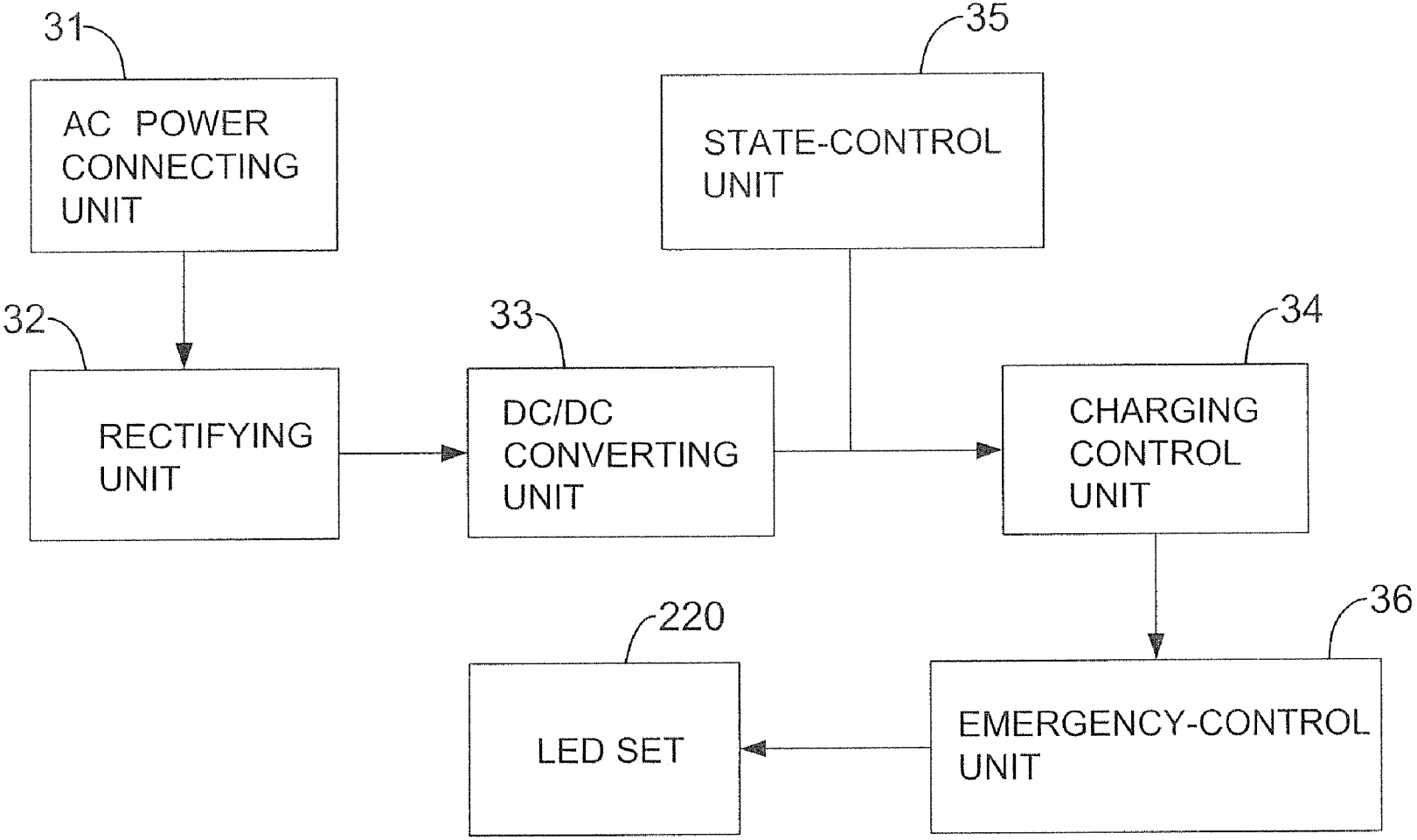
FIG. 3 is a block diagram of a control box of the luminary in FIG. 1.
Figure 4A:
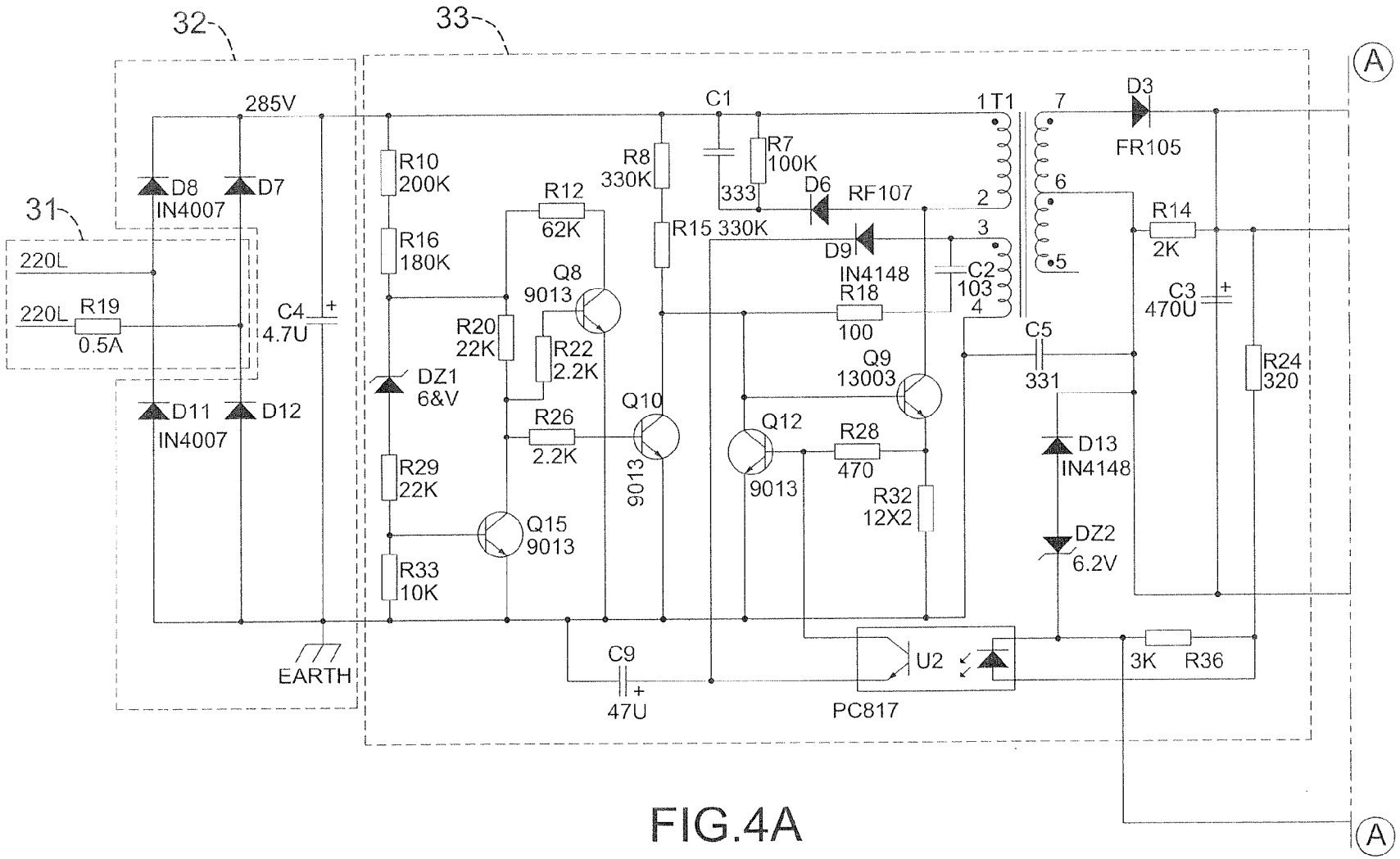
FIG. 4A is a part of a detailed circuit diagram of the control box of the luminary in FIG. 1.
Figure 4B:
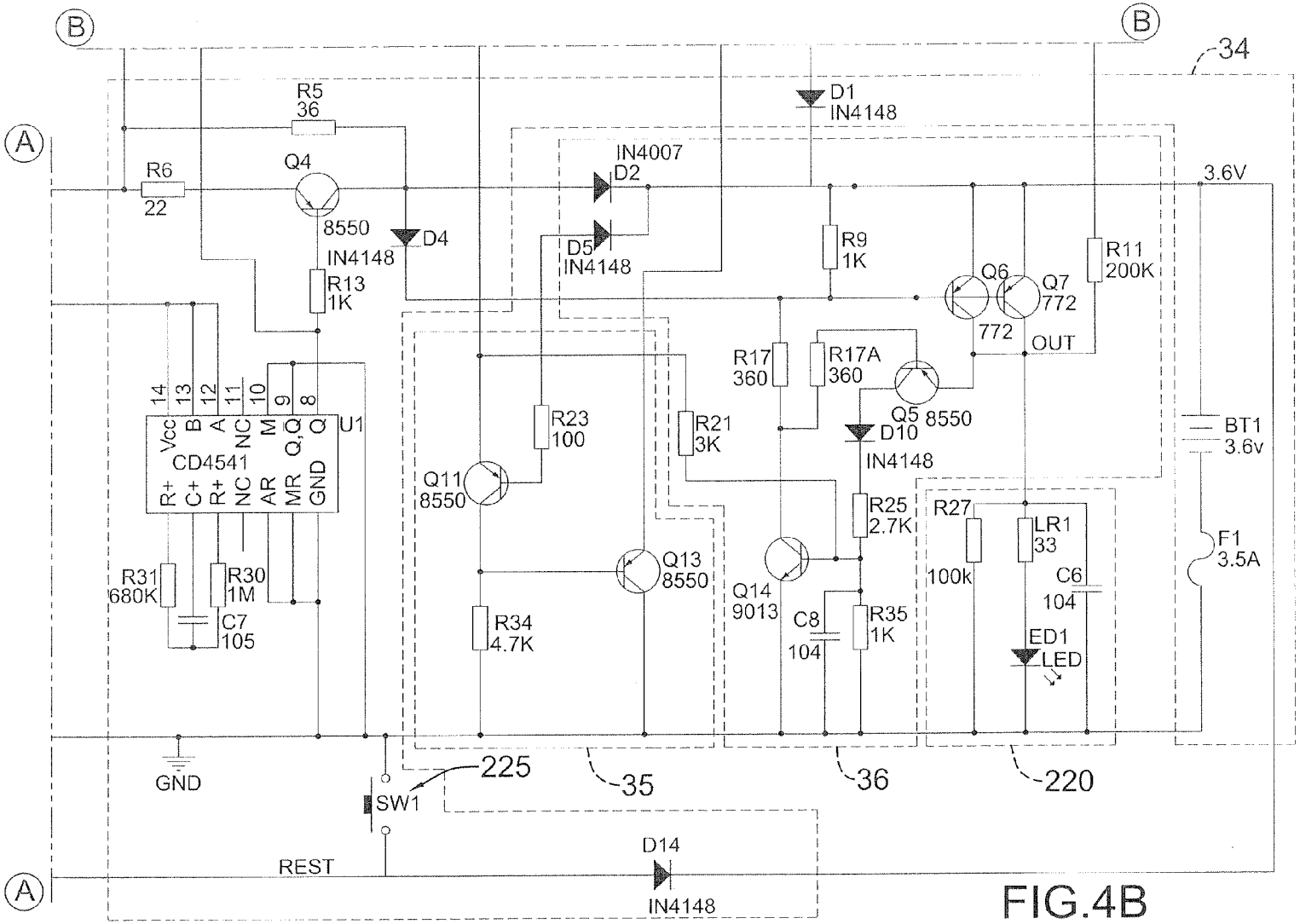
FIG. 4B is another part of a detailed circuit diagram of the control box of the luminary in FIG. 1.
Figure 4C:
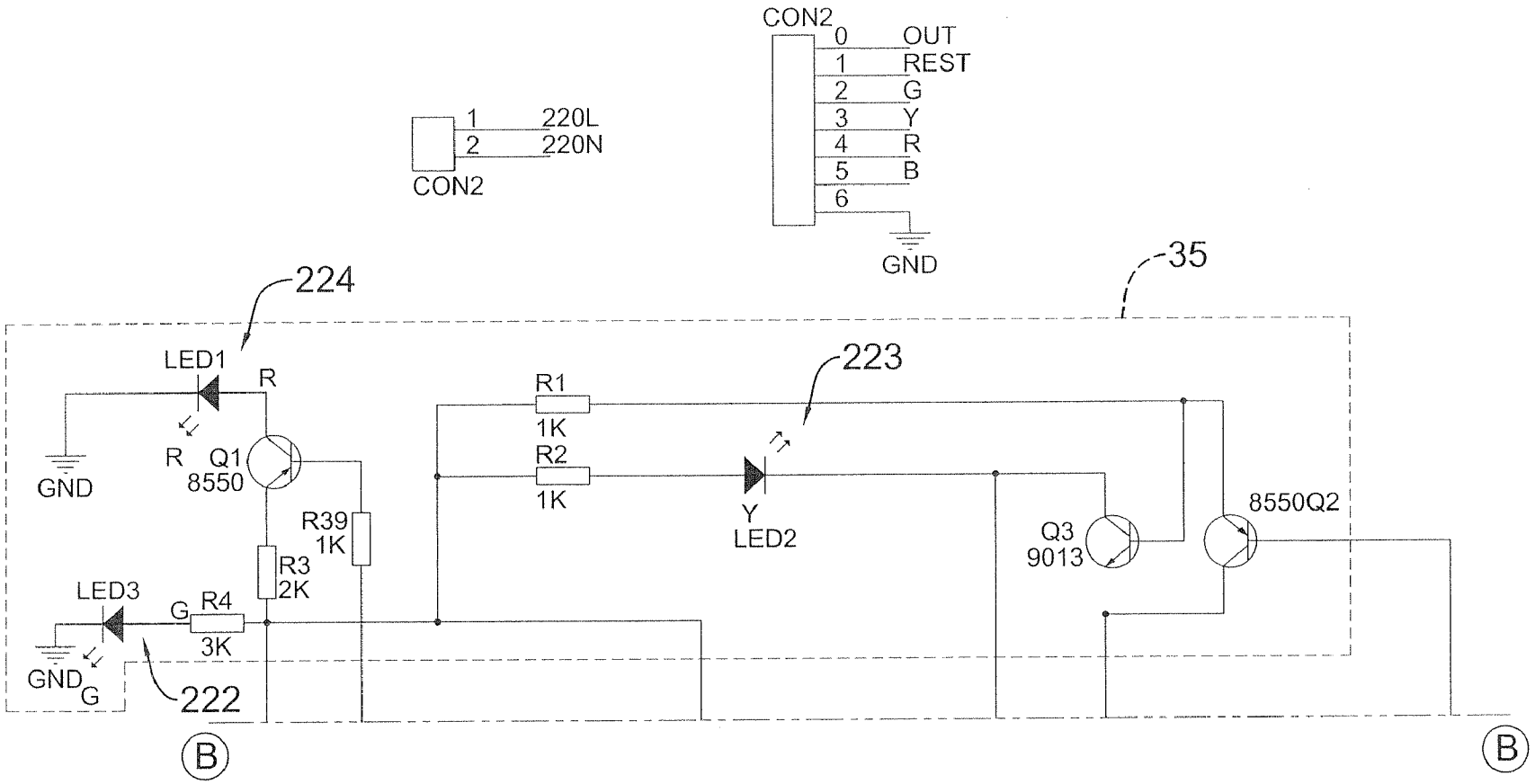
FIG. 4C is the other part of a detailed circuit diagram of the control box of the luminary in FIG. 1.

With further reference to FIG. 2, the base (21) is ring-shaped, attached to and surrounds the light-emitting end of the central lamp (10) and may have an opening and an inner edge (210) defining the opening. The opening is wider than the front open end of the shade (12) of the central lamp (10) but narrower than the circular flange (120) of the shade (12). The inner edge (210) is clamped by the circular flange (120) and the reeds (121) so as to fix the base (21) of the emergency lamp (20) to the central lamp (10).

The circuit board (22) is ring-shaped, mounted on the base (21) and has a surface, an LED set (220), a cable set (221) and may have a malfunction-state light (223), a normal-state light (222), a charging-state light (224) and a testing switch (225). The LED set (220) is mounted on the surface, faces an identical direction with the light-emitting end of the central lamp (10) and may have multiple light emitting diodes arranged as a ring. The cable set (221) is electrically connected to the LED set (220). The malfunction-state light (223), the normal-state light (222), the charging-state light (224) and the testing switch (225) are mounted on the surface of the circuit board (22) side by side and electrically connected to the cable set (221).

The cover (23) is transparent and mounted on the base (21) and covers the circuit board (22).

The control box (30) is electrically connected to the cable set (221) of the circuit board (21), adapted to connect to an AC power and has a battery. Via the cable set (221), the control box (30) drives the LED set (220) during an outage of the AC power by using power of the battery and may drive the charging-state light (224) when charging the battery, drive the normal-state light (222) when the AC power is regularly supplied and drive the malfunction-state light (223) when circuits of the control box (30) fail.

With further reference to FIGS. 3, 4A to 4C, the control box (30) may further comprise an AC power connecting unit (31), a rectifying unit (32), a DC/DC converting unit (33), a charging control unit (34), a state-control unit (35) and an emergency-control unit (36).

The AC power connecting unit (31) is adapted to connect to AC power and may have a resistor (R19) to prevent damage of short-circuit current. The rectifying unit (32) is connected to the AC power connecting unit (31) and rectifies the AC power to a DC power and may be a bridge rectifier. The DC/DC converting unit (33) is connected to the rectifying unit (32) and converts the DC power to a stable and applicable voltage value and may be composed of a transformer (T1), multiple transistors, multiple diodes and an opto-coupler (PC817). The charging control unit (34) is connected to the DC/DC converting unit (33) and the testing switch (225) of the circuit board (22) and has a transistor (Q4) and a control chip (U1). The transistor (Q4) connects to a battery (BT1) of the control box (30). The control chip (U1) controls the transistor (Q4) to charge the battery (BT1) in a period of time and may switch off the voltage supply from the DC/DC converting unit (33) to simulate a blackout situation when the testing switch (225) is pressed.

The state-control unit (35) is connected between the DC/DC converting unit (33) and the charging control unit (34) and connects to the charging-state light (224), the malfunction-state light (223) and the normal-state light (222) of the circuit board (22). The state-control unit (35) functions to drive the charging-state light (224) when charging the battery (BT1), drive the malfunction-state light (223) when circuits of the control box fails and drive the normal-state light (222) when the AC power is regularly supplied to the AC power connecting unit (31).

The emergency-control unit (36) is connected to the LED set (220) and drives the LED set (220) with the power of the battery (BT1) when an outage of the AC power occurs until power of the battery (BT1) decrease to a threshold value.

The luminary is easily assembled wherein the emergency lamp (20) is mounted around the central lamp (10) so as to emit lights in an identical direction with the central lamp (10) during a blackout. Furthermore, the luminary provides normal and emergency illuminations respectively with the central lamp (10) and the emergency lamp (20) to prevent emergency power of battery from being quickly consumed by the central lamp (10) that is usually high-power-consuming. Besides, the emergency lamp (20) provides the malfunction-state light (223), the normal-state light (222), the charging-state light (224) and the testing switch (225) for safety inspection.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A luminary comprising:

a central lamp having a light-emitting end;

an emergency lamp being ring-shaped, mounted around the light-emitting end of the central lamp and having a base being ring-shaped, attached to and surrounding the light-emitting end of the central lamp; and a circuit board being ring-shaped, mounted on the base and having a surface;

an LED set being mounted on the surface and facing an identical direction with the light-emitting end of the central lamp;

a cable set being connected to the LED set; and a malfunction-state light, a normal-state light, a charging-state light and a testing switch being mounted on the surface of the circuit board side by side and electrically connected to the cable set; and a control box being electrically connected to the cable set of the circuit board, adapted to connect to an AC power, having a battery, driving the LED set when an outage of the AC power occurs by using power of the battery, driving the charging-state light when charging the battery, driving the malfunction-state light when circuits of the control box fail and driving the normal-state light when the AC power is regularly supplied.

2. The luminary as claimed in claim 1, wherein the central lamp has a socket a shade being attached to the socket and having a front open end;

a circular flange being formed on and protrudes from the front open end; and multiple reeds being mounted on the front open end, being adjacent to the circular flange and being elastic; and a light emitting element being mounted on the socket in the shade; and the base of the emergency lamp has an opening being wider than the front open end of the shade of the central lamp and narrower than the circular flange of the shade; and an inner edge defining the opening and being clamped by the circular flange and the reeds.

3. The luminary as claimed in claim 2, wherein the central lamp further has a frame being fixed to the socket and the shade.

4. The luminary as claimed in claim 1, wherein the emergency lamp further has a cover being transparent, mounted on the base and covering the circuit board.

5. The luminary as claimed in claim 2, wherein the emergency lamp further has a cover being transparent, mounted on the base and covering the circuit board.

6. The luminary as claimed in claim 1, wherein the LED set of the circuit board has multiple light emitting diodes arranged as a ring.

7. The luminary as claimed in claim 1, wherein the control box has an AC power connecting unit being adapted to connect the AC power;

a rectifying unit being connected to the AC power connecting unit and rectifying the AC power to a DC power;

a DC/DC converting unit being connected to the rectifying unit and converting the DC power to a stable and applicable voltage value;

a charging control unit being connected to the DC/DC converting unit and the testing switch of the circuit board and having a transistor connecting to the battery of the control box; and a control chip controlling the transistor to charge the battery in a period of time and switching off the voltage supply from the DC/DC converting unit to simulate a blackout situation when the testing switch is pressed a state-control unit being connected between the DC/DC converting unit and the charging control unit, connecting to the malfunction-state light, the normal-state light and the charging-state light of the circuit board and functioning to drive the charging-state light when charging the battery, drive the malfunction-state light when circuits of the control box fails and drive the normal-state light when the AC power is regularly supplied to the AC power connecting unit; and an emergency-control unit being connected to the LED set and driving the LED set with the power of the battery when an outage of the AC power occurs.

8. The luminary as claimed in claim 2, wherein the control box has an AC power connecting unit being adapted to connect the AC power;

a rectifying unit being connected to the AC power connecting unit and rectifying the AC power to a DC power;

a DC/DC converting unit being connected to the rectifying unit and converting the DC power to a stable and applicable voltage value;

a charging control unit being connected to the DC/DC converting unit and the testing switch of the circuit board and having a transistor connecting to the battery of the control box; and a control chip controlling the transistor to charge the battery in a period of time and switching off the voltage supply from the DC/DC converting unit to simulate a blackout situation when the testing switch is pressed a state-control unit being connected between the DC/DC converting unit and the charging control unit, connecting to the malfunction-state light, the normal-state light and the charging-state light of the circuit board and functioning to drive the charging-state light when charging the battery, drive the malfunction-state light when circuits of the control box fails and drive the normal-state light when the AC power is regularly supplied to the AC power connecting unit; and an emergency-control unit being connected to the LED set and driving the LED set with the power of the battery when an outage of the AC power occurs.

* * * * *